US010927722B2

(12) United States Patent
Heym et al.

(10) Patent No.: US 10,927,722 B2
(45) Date of Patent: Feb. 23, 2021

(54) CAM PHASER AND MOUNTING METHOD

(71) Applicant: ECO Holding 1 GmbH, Marktheidenfeld (DE)

(72) Inventors: Rene Heym, Ostfildern/Ruit (DE); Norbert Loesch, Kirchheim (DE); Markus Todt, Oberboihingen (DE); Stefan Wanner, Biberach a.d. Riss (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/782,194

(22) Filed: Feb. 5, 2020

(65) Prior Publication Data

US 2020/0256220 A1 Aug. 13, 2020

(30) Foreign Application Priority Data

Feb. 8, 2019 (DE) ..... 10 2019 103 161.3

(51) Int. Cl.
*F01L 1/344* (2006.01)

(52) U.S. Cl.
CPC ... *F01L 1/3442* (2013.01); *F01L 2001/34483* (2013.01); *F01L 2303/01* (2020.05)

(58) Field of Classification Search
CPC ..... F01L 1/3442; F01L 2001/3445; F01L 2001/34483; F01L 1/46; F01L 2301/00; F01L 2303/01
USPC ..... 123/90.15, 90.17
See application file for complete search history.

(56) References Cited

U.S. PATENT DOCUMENTS

2010/0075765 A1* 3/2010 Isenberg ..... F01L 1/3442 464/160
2012/0152188 A1* 6/2012 Weber ..... F01L 1/3442 123/90.15
2012/0298058 A1* 11/2012 Fischer ..... F01L 1/3442 123/90.15
2014/0311432 A1* 10/2014 Noguchi ..... F01L 1/3442 123/90.15
2017/0145872 A1* 5/2017 Noguchi ..... F01L 1/3442

FOREIGN PATENT DOCUMENTS

DE 102013209053 A1 11/2014
DE 102013209054 A1 11/2014
DE 102017114202 B3 9/2018

* cited by examiner

*Primary Examiner* — Jorge L Leon, Jr.
(74) *Attorney, Agent, or Firm* — Von Rohrscheidt Patents

(57) ABSTRACT

A vane type cam phaser for an internal combustion engine, the vane type cam phaser including a stator and a rotor that is rotatable relative to the stator to adjust a phase angle of a camshaft; a spring element configured to align the rotor with the stator in an idle position; a spring adapter that is arranged between the spring element and the rotor and an axial fixing device that fixes the spring adapter at the rotor.

14 Claims, 4 Drawing Sheets

CAM PHASER AND MOUNTING METHOD

RELATED APPLICATIONS

This application claims priority from and incorporates by reference German Patent Application DE 10 2019 103 161.3 filed on Feb. 8, 2019.

FIELD OF THE INVENTION

The invention relates to a vane-type cam phaser and a method for mounting the cam phaser.

BACKGROUND OF THE INVENTION

Cam phasers of this type are used in valve trains of internal combustion engines in order to variably adjust a phase relationship between a crank shaft and a cam shaft in an optimum manner.

DE 10 2017 11 4202 B3 discloses a vane-type cam phaser for an internal combustion engine comprising a stator and a rotor that is arranged in the stator rotatable relative thereto and configured to adjust a phase angle of a camshaft. Thus a spring is arranged between the stator and the rotor so that the stator and the rotor are aligned relative to each other in an idle position. Thus the spring is coupled to the rotor by a spring receiver and the spring receiver is configured as a sleeve-shaped spring receiver that is concentric to the rotor. Thus the spring receiver includes a cylinder section and an axially adjacent ring section wherein an outer diameter of the ring section exceeds an axially diameter of the cylinder section. The ring section and the cylinder section are thus integrally connected with each other. The ring section and/or the cylinder section includes a flat portion that is configured to be connected with the rotor in a form-locking manner.

This art relates in particular to hydraulic cam phasers that are preloaded in rotation direction by a spring.

BRIEF SUMMARY OF THE INVENTION

Thus, is it an object of the invention to improve the generic cam phaser recited supra from a configuration point of view and/or with respect to its function and to make the assembly of the cam phaser more efficient.

According to an aspect of the invention, the object is achieved by a cam phaser. The cam phaser, in particular a vane-type cam phaser for an internal combustion engine, includes a stator and a rotor that is rotatable relative to the stator, wherein the rotor is configured to adjust a phase angle of a camshaft. The cam phaser furthermore includes a spring element configured to align the rotor with the stator in an idle position, a spring adapter that is arranged between the spring element and the rotor, and an axial fixing device that fixes the spring adapter at the rotor.

The improved cam phaser according to the invention has the advantage that a spring tension can be applied to the spring element by the spring adapter also after the spring element is installed into the cam phaser in a non-preloaded condition. Therefore, the cam phaser is without spring tension until the spring adapter is fixed at the rotor. Thus, unimpaired end of line inspection of the cam phaser is possible which helps quality control. Binding or excessive friction of the rotor in the stator is only measurable without preload in the spring element or at least measurable more precisely.

Advantageous embodiments are provided in the dependent claims and independent claims.

According to an advantageous embodiment the spring element is configured as a coil spring. In the coil spring a spring wire is wound into a helix. A winding shape of this type is particularly suitable for safely receiving a component, thus the spring adapter that is configured for loading and/or arresting the spring element. A particularly stable support of the spring adapter at the spring element and thus in the cam phaser is thus provided. The spring element can be configured as clock spring, a coil spring or a torsion spring.

In a particularly advantageous embodiment, a locking disc is provided that is connected with the stator torque-proof, advantageously by a threaded connection wherein the spring element is fixed in the locking disc. The locking disc which advantageously has a central mounting opening is used for covering the rotor and sealing pressure cavities between the rotor and the stator. Due to its torque-proof connection with the stator, the locking disc is very well suited for fixing the spring element at the stator, in particular as a counter piece to the spring adapter in which the spring element is also fixed or interlocked. A connection path between the spring element and the stator that would be long otherwise is thus bridged in a simple manner.

Advantageously, a contact ring is provided wherein the spring element is fixed in the locking disc by the contact ring. The contact ring is thus connected torque-proof and form-locked with the locking disc. The contact ring is a replaceable component and forms a protective component for the locking disc relative to the spring element. Thus, a light and soft material, advantageously aluminum, can be used to produce the locking disc which saves weight in the cam phaser. Since the replaceable contact disc is very small relative to the locking disc, material and cost are saved during the replacement.

Thus, the contact ring is advantageously made from a hard metal, particularly advantageously from steel. The hard metal is resistant relative to abrasion or scratching caused by the spring element that is fixed in the contact ring. This assures that the spring element does not dig into the contact ring which would change its position and clamping properties.

According to an advantageous embodiment, the spring adapter includes an inner contour that facilitates torque transmission. The inner contour is thus advantageously configured so that the spring adapter is rotatable or adjustable by a commercially available tool. The spring element is preloaded by rotating the spring adapter. Preloading the spring element and/or fixing the spring adapter can thus be performed in a very simple manner.

According to another advantageous embodiment, the axial fixing device is configured with at least one fixing pin. Thus, the fixing pin connects the spring adapter with the rotor in an axial form-locking manner. Advantageously, two or more fixing pins are used in order to facilitate a centering of the spring adapter using the fixing pins and/or in order to achieve a higher stability when fixing or connecting the spring adapter and the rotor.

Accordingly, the spring adapter and the rotor are respectively configured with at least one fixing opening, wherein the fixing openings are configured to receive the at least one fixing pin. The spring adapter and the rotor are thus connectable in a simple manner in an axial direction by form locking. The at least one fixing opening at the spring adapter is thus advantageously configured as a continuous opening. Thus, the fixing pin is insertable or impressible into the fixing openings after installing or arranging the spring adapter between the fixing element and the rotor.

According to the invention, the rotor is advantageously configured with a sickle-shaped contour which is configured for guiding at least one fixing pin. Advantageously, the sickle-shaped contour guides the fixing pin which protrudes on a side of the spring adapter that is oriented towards the rotor wherein the guiding is performed by rotating the spring adapter from a starting position or inserting position into an end position or interlocking position. Correct clamping of the spring element and precise radial positioning of the spring adapter relative to the rotor are thus assured and simplified considerably.

Additionally, the rotor advantageously includes at least one recess in which the spring adapter is interlockable. The recess is thus configured so that the entire shape of the spring adapter and/or at least a protrusion of the spring adapter is receivable therein. This assures correct placement of the spring adapter in a starting position and handling is simplified greatly.

According to another aspect of the invention, the object is achieved by a method for mounting a cam phaser according to one of the embodiments recited supra. The method has similar advantages as the cam phaser according to the invention and includes the steps applying the spring adapter to the rotor, engaging the spring element in the spring adapter, torque-proof connecting of the spring element with the stator, clamping the spring element by rotating the spring adapter and axial fixing of the spring adapter at the rotor. The method facilitates mounting the cam phaser including quality control or end of line testing without spring preload of the spring element. This facilitates performing a friction test to prevent wear and a pressure test in the pressure chambers between the rotor and the stator in a precise manner. Additionally, assembly is simplified considerably when there is no tension in the system or between the components that are to be assembled.

In an advantageous embodiment of the method, the rotation of the spring adapter is supported in a sickle-shaped contour in the rotor. The sickle-shaped contour is advantageously provided for guiding at least one fixing pin as recited supra, wherein the fixing pin is guided during rotation of the spring adapter from a starting position into an end position. Thus, the spring element is preloaded correctly and the spring adapter is moved into a precisely defined position that is required for the axial fixing.

Additionally, at least one fixing opening in the spring adapter and at least one fixing opening in the rotor are aligned with each other when the spring adapter is rotated according to the invention. Thus, aligning means a precise alignment of two fixing openings and facilitates a particularly simple fixing of the spring adapter at the rotor.

Thereafter, the axial fixing is advantageously performed by inserting a fixing pin into the fixing openings in the spring adapter and in the rotor. A fixing pin, advantageously a bolt, is then advantageously inserted into the rotor through the spring adapter so that form locking is established between the spring adapter and the rotor.

In an advantageous embodiment of the method, preloading the spring element and fixing the spring adapter is advantageously performed through a mounting opening of the locking disc that is connected with the stator torque-proof. As recited supra, the locking disc is advantageously configured with a central mounting opening, e.g., configured as a borehole. The mounting opening is required to introduce a central bolt between the cam phaser and the camshaft when the cam phaser is installed at an internal combustion engine. A preload is applied to the spring element from an outside through the mounting opening when the cam phaser is completely assembled and the spring adapter is fixed at the rotor.

In another advantageous embodiment, the spring adapter is fixed at the rotor by at least one fixing pin in a preliminary manner during transportation from an assembly facility to an installation location. Thus, the spring element remains without preload. Thus, the spring adapter is held in a stable transport position, and the spring element is not loaded before final installation.

The material and/or the configuration of the at least one fixing pin is advantageously selected so that the fixing pin maintains its fixing function after the axial fixing of the spring adapter at the rotor until the central bolt has established the friction locking between the spring adapter and the rotor. Thus, the fixing pin is a transport and mounting tool which becomes redundant after the spring adapter has been installed. This has the advantage that the fixing pin is only loaded for a short time, which minimizes material fatigue of the fixing pin.

BRIEF DESCRIPTION OF THE DRAWINGS

The invention is now described based on embodiments with reference to a drawing figure, wherein.

DETAILED DESCRIPTION OF THE INVENTION

A vane-type cam phaser 1 that is illustrated FIGS. 1-6 adjusts a phase relationship between a crankshaft and a camshaft in valve trains of internal combustion engines.

Figure 1:
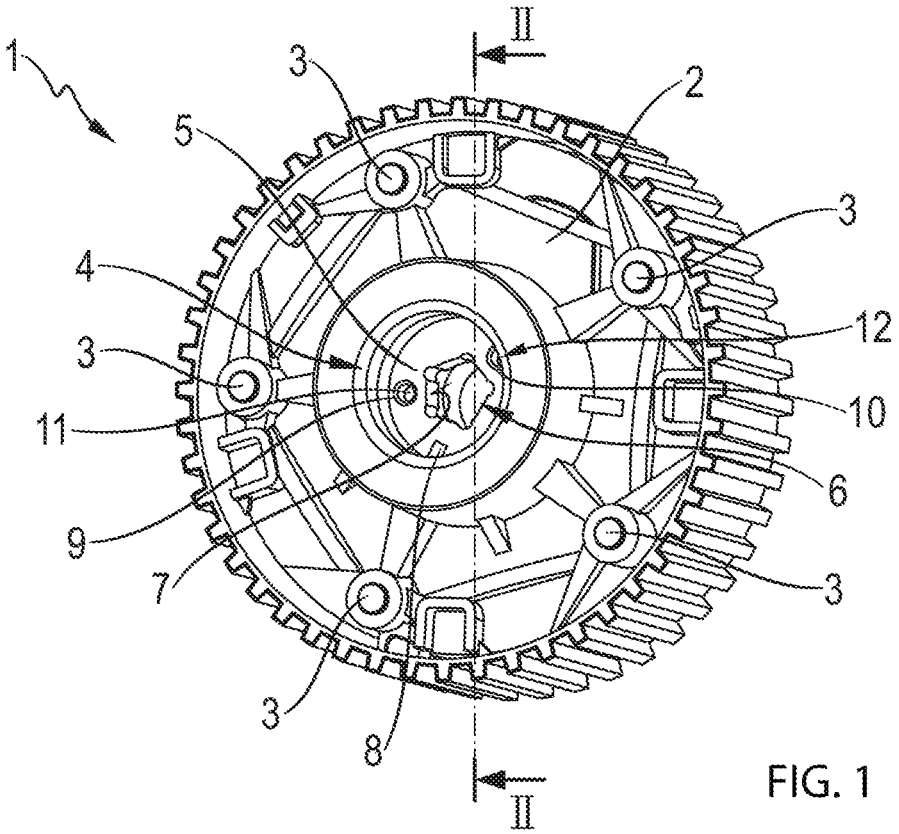
FIG. 1 illustrates a perspective view of a first embodiment of a cam phaser according to the invention.

FIG. 1 illustrates a cam phaser 1 in a completely preassembled condition. The cam phaser 1 includes a locking disc 2 which is connected with the cam phaser 1 by plural threaded connections 3. Thus, the locking disc 2 includes a mounting opening 4 in a radial center and a spring adapter 5 is visible through the mounting opening. The spring adapter 5 has a central opening 6 that is configured with an inner contour 7 and an arresting groove 8 that is arranged at an outer edge of the spring adapter. Furthermore, the spring adapter 5 is configured with a first fixing opening 9 and a second fixing opening 10, wherein a first fixing pin 11 is arranged in the first fixing opening 9 and a second fixing pin 12 is arranged in the second fixing opening 10.

The locking disc 2 includes the mounting opening 4 primarily in order to connect the cam phaser 1 with a cam shaft using a central bolt. Additionally, it is possible in the cam phaser 1 according to the invention to access the spring adapter 5 through the mounting opening 4. Thus, a tool that fits the inner contour 7 of the central opening 6 can be inserted into the spring adapter 5 in order to rotate the spring adapter 5 into a fixing position. When rotating the spring adapter 5, the fixing pins 11, 12 are not yet or at least not yet completely inserted into the fixing openings 9, 10 or recessed therein. Only when the spring adapter 5 is moved into the fixing position the fixing pins 11, 12 are recessed into the fixing openings 9, 10 completely to fix the spring adapter 5. FIG. 1 illustrates the end condition after fixing the spring adapter 5.

Figure 2:
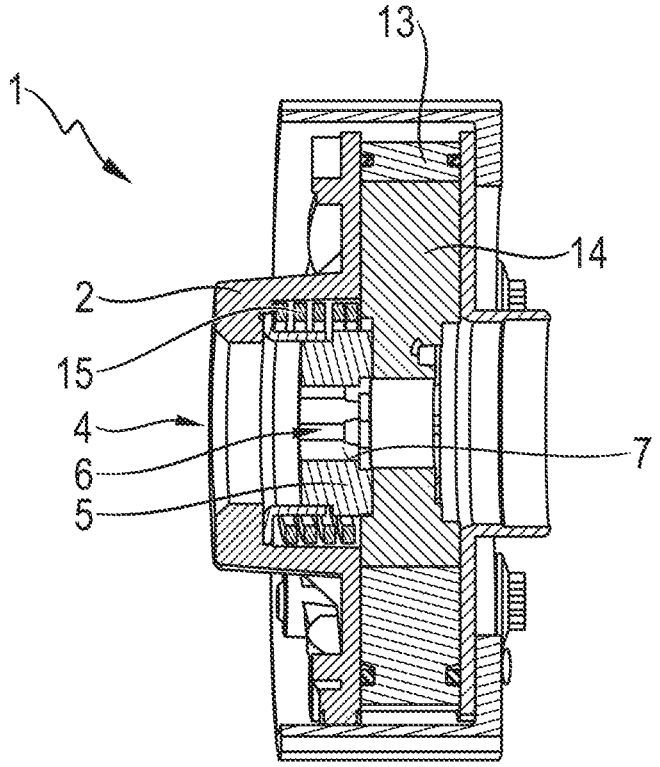
FIG. 2 illustrates a longitudinal sectional view according to II-II in FIG. 1.

FIG. 2 illustrates the cam phaser 1 of FIG. 1 in a longitudinal sectional view. Out of the components shown in FIG. 1, FIG. 2 shows the locking disc 2 with the mounting opening 4 and the spring adapter 5 with the central opening 6 and the inner contour 7. Additionally, a stator 13 and a rotor 14 are illustrated which form essential components of the cam phaser 1. A spring element 15 and a contact ring 16 are arranged between the locking disc 2 and the spring adapter 5.

The spring element 15 configured as a coil spring is terminated at the spring adapter 5 and through the contact ring 16 also terminated at the locking disc 2. The spring element 15 is loaded by rotating the spring adapter 5 and retained at the rotor 14 in this condition by fixing the spring adapter 5. A preload of the spring element 15 is necessary to align the stator 13 and the rotor 14 in an idle position of the cam phaser 1.

In the last assembly step, the spring element 15 is loaded which facilitates unimpaired end of line testing of the cam phaser 1.

Figure 3:
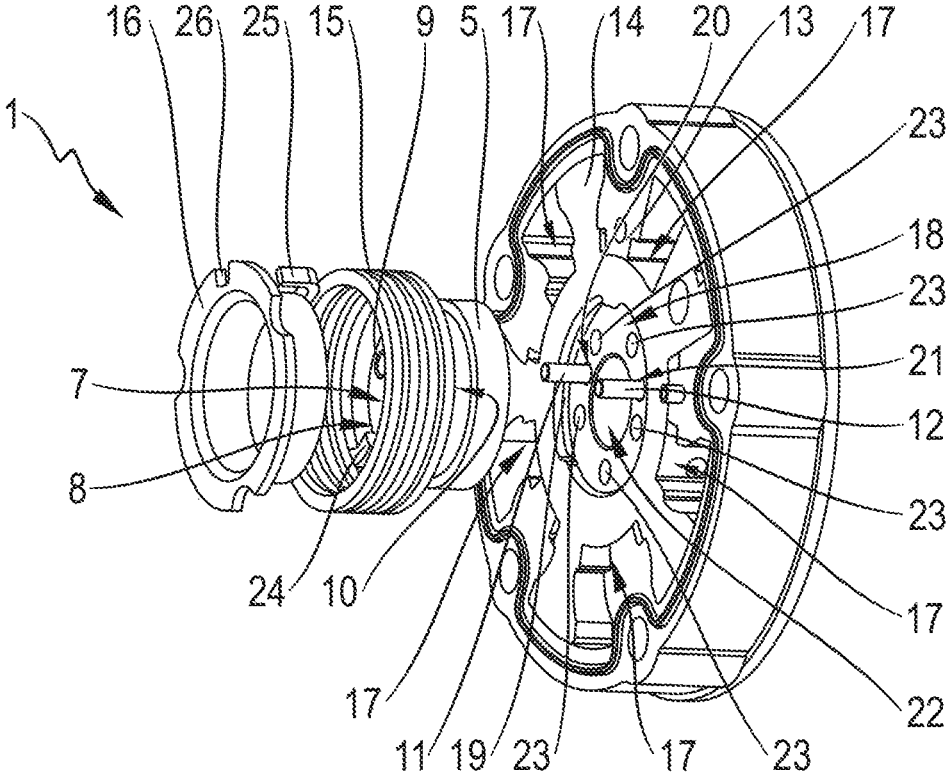
FIG. 3 illustrates a perspective exploded view of a second embodiment of the cam phaser according to the invention.

FIG. 3 illustrates an exploded view of a cam phaser 1, e.g. the cam phaser of FIGS. 1 and 2. The cam phaser 1 includes a stator 13 and a rotor 14. Pressure chambers 17 are arranged in intermediary spaces of the stator 13 and the rotor 14. A spring adapter 5, a spring element 15, and a contact ring 16 are illustrated in the exploded view in sequence viewed from the rotor and are put together in the same sequence during assembly.

The rotor 14 includes a circular recess 18 with a sickle-shaped contour 19 adjoining thereto. A first fixing opening 20 and a second fixing opening 21 are arranged in the recess 18 wherein a first fixing pin 11 is partially inserted into the first fixing opening 20 and a second fixing pin 12 is partially inserted into the second fixing opening 21. The spring adapter 5 includes a central opening 6 (not illustrated) with an inner contour 7, an arresting notch 8 and a first fixing opening 9 and a second fixing opening 10. The fixing openings 9, 10 of the spring adapter 5 and the fixing openings 20, 21 of the rotor 14 form an axial fixing device 22 together with the fixing pins 11, 12. Plural oil bore holes 23 are arranged within the recess 18, wherein the oil bore holes, however, do not form part of the fixing device 22.

The spring element 15 includes a first arresting spout 24 at an end oriented towards the spring adapter 5 and a second arresting spout 25 at an end oriented towards the contact ring 16. Thus, the first arresting spout 24 is to be arranged in the arresting notch 8 of the spring adapter 5. Accordingly the contact ring 16 has an arresting notch 26 in which the second arresting spout 25 is to be arranged FIG. 3 illustrates the components of cam phaser 1 in a final assembly condition in which the spring element 15 is preloaded and the spring adapter 5 is fixed at the rotor 14. Preloading the spring element 15 is performed as illustrated in FIG. 1 by rotating the spring adapter 5 using a tool that precisely fits the central opening 6 or its inner contour 7. Thereafter fixing pins 11, 12 are inserted through the fixing openings 9 10 of the spring adapter 5 into the fixing openings 20, 21 of the rotor 14 so that the spring adapter 5 is fixed at the rotor 14. In order to facilitate the fixing the fixing openings 9, 10 have to be aligned with the fixing openings 20, 21. The manner how this alignment is performed is described infra with reference to FIG. 4.

Figure 4:
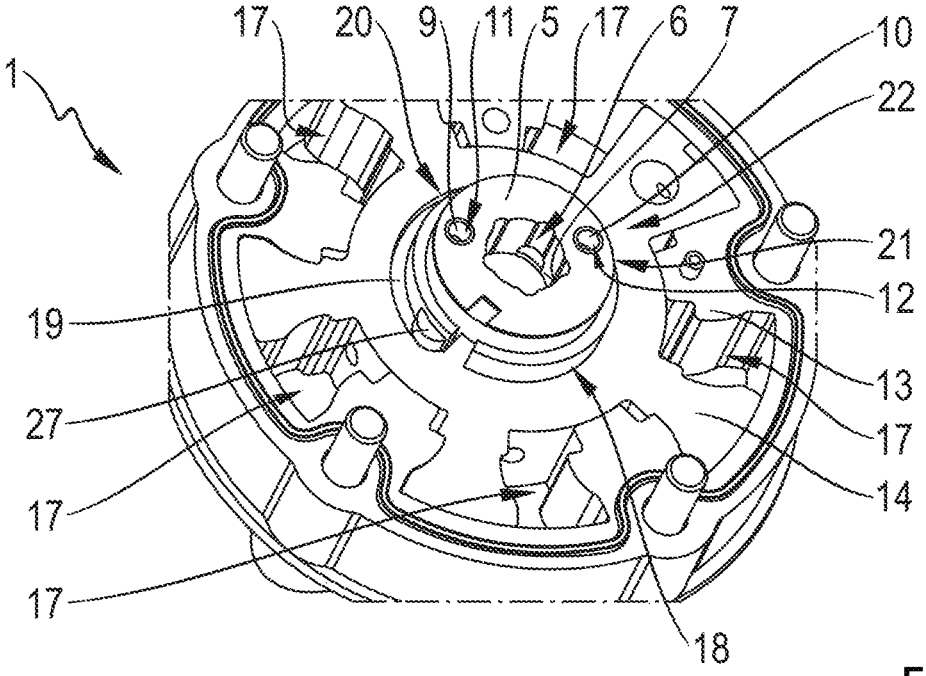
FIG. 4 illustrates a perspective partial view of the cam phaser in FIG. 3.

FIG. 4 illustrates a perspective partial view of the cam phaser 1 illustrated in FIG. 3 which only shows the stator 13, the rotor 14 and the spring adapter 5. Also here the pressure cavities 17 between the stator 13 and the rotor 14 are visible. Thus, the spring adapter 5 is inserted into the recess 18 of the rotor 14 and fixed by the axial fixing device 22 at the rotor 14. As recited supra the axial fixing device 22 includes the fixing openings 9, 10 of the spring adapter 5, the fixing openings 20, 21 of the rotor 14 and the fixing pins 11, 12. The sickle shaped contour 19 is visible which directly adjoins the recess 18 of the rotor 14. A guide lug 27 is also visible that is configured integrally in one piece with the spring adapter 5 and arranged within the sickle shaped contour 19.

The illustrated components are arranged in a final assembly condition. Thus, the spring adapter 5 is already fixed at the rotor 14. The required alignment of the fixing openings 9, 10 with the fixing openings 20, 21 is achieved by the guide lug 27 of the spring adapter 5 and the sickle shaped contour 19 in the rotor 14. Thus, the guide lug 27 and the sickle shaped contour 19 only facilitate a rotation of the spring adapter 5 by a predetermined rotation angle in a predetermined rotation direction. As soon as the guide lug 27 reaches the end stop of the sickle shaped contour 19 during rotation of the spring adapter 5 the fixing openings 9, 10 are arranged exactly above the fixing openings 20, 21 and are aligned therewith.

Figure 5:
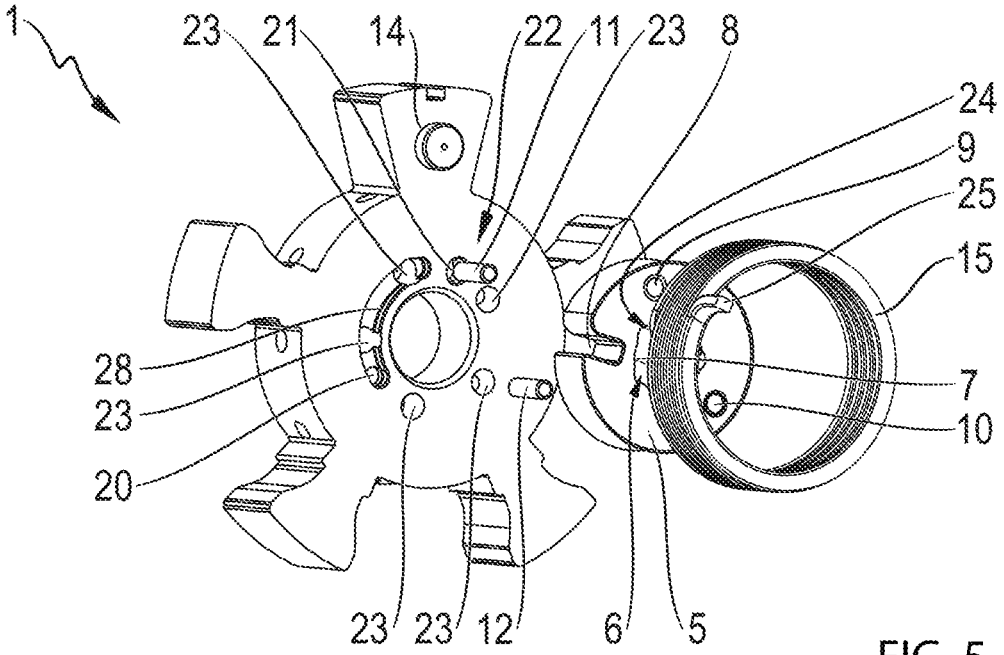
FIG. 5 illustrates a perspective exploded partial view of a third embodiment of a cam phaser according to the invention in unloaded condition.

FIG. 5 illustrates a perspective exploded partial view of a cam phaser 1 in unloaded condition. This can also be e.g. the cam phaser 1 of FIGS. 1 and 2. Thus, FIG. 5 only illustrates a rotor 14, a spring adapter 5 and a spring element 15 and an axial fixing device 22. Also in this case, the rotor 14 also includes plural oil bore holes 23. The fixing device 22 incudes a first fixing opening 9 and a second fixing opening 10 in the spring adapter 5, a first fixing opening 20 and a second fixing opening 21 in the rotor 14 and a first fixing pin 11 and a second fixing pin 12. Furthermore the fixing device 22 includes a sickle shaped contour 28. It is appreciated that the sickle shaped contour 28 differs from the sickle shaped contour 19 in FIGS. 3 and 4. Thus e.g. the first fixing opening 20 of the rotor 14 is arranged within the sickle shaped contour 28.

Also in this embodiment the spring adapter 5 includes a central opening 6 with an inner contour 7, an arresting notch 8 and the fixing openings 9, 10 recited supra. By the same token the spring element 15 includes a first arresting spout 24 at an end that is oriented towards the spring adapter 5 and a second arresting spout 25 at an end that is oriented away from the spring adapter 5.

Thus, the cam phaser 1 of FIG. 5 is in the unloaded condition so that the spring element 15 does not have any preload and the arresting spouts 24, 25 are arranged in a predetermined idled position relative to each other. The position of the arresting spout 25 is provided for fixing with a non-illustrated stator and therefore the position is not adjustable or static. Thus, also the position of the arresting spout 24 is predetermined for the non-preloaded spring element 15. Thus, the arresting spout 24 fixes a rotational position of the spring adapter 5 due to its arrangement in the arresting notch 8 and thus also fixes the position of the fixing openings 9, 10 for the fixing pins 11, 12.

The sickle shaped contour 28 is arranged in the rotor 14 so that the first fixing pin 11 interlocks in the sickle shaped contour 28 when inserted into the first fixing opening 9. The second fixing pin 12, however, impacts a point on the rotor 14 when inserted into the second fixing opening 10, wherein the point is arranged outside of the sickle shaped contour 28. None of the fixing pins 11, 12 are arranged in the fixing openings 20, 21 arranged in the rotor 14 at this point in time or in this assembly condition.

Since the first fixing pin 11 impacts the sickle shaped contour 28 when inserted into the first fixing opening 9 this first fixing pin is insertable further through the spring adapter 5 than the second fixing pin 12. The second fixing pin 12 protrudes at a side of the spring adapter 5 that is oriented away from the rotor 14 by approximately 2-5 mm from the second fixing opening 10 after the second fixing pin 12 is inserted into the spring adapter 5. Starting from this assembly condition the cam phaser 1 can be moved into a final assembly condition by rotating and fixing the spring adapter 5. Thus, the interlocked first fixing pin 11 is moved along the sickle shaped contour 28 to an end stop of the sickle shaped contour 28. The fixing openings 9, 10 of the spring adapter 5 and the fixing openings 20, 21 of the rotor are thus brought into alignment so that the fixing pins 11, 12 are movable to their respective end position towards the rotor 14. Additionally the position of the arresting notch 8 and the arresting spout 24 interlocked therein change so that the spring element 15 is moved into a preloaded condition. The final assembly position of the cam phaser 1 is illustrated in FIG. 6.

Figure 6:
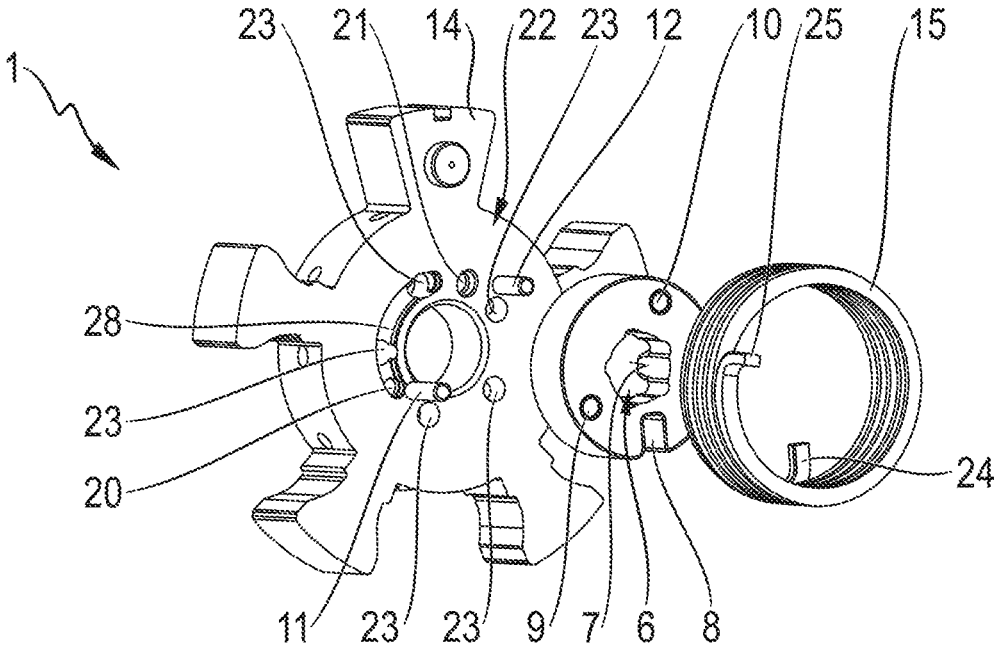
FIG. 6 illustrates a perspective exploded partial view of the cam phaser in FIG. 5 in a preloaded condition.

FIG. 6 illustrates a perspective exploded partial view of the cam phaser 1 of FIG. 5 in preloaded condition and thus in final assembly position. Thus, the first arresting spout 24 of the spring element 15, the spring adapter 5 with its arresting notch 8 and its fixing openings 9, 10 and the fixing pins 11, 12 are rotated and/or moved relative to the illustration of FIG. 5 by an angle and distance that is predetermined by the sickle shaped contour 28. All illustrated components and their functions were already described in detail with respect to FIG. 5 and therefore are not described again with respect to FIG. 6.

Figure 7:
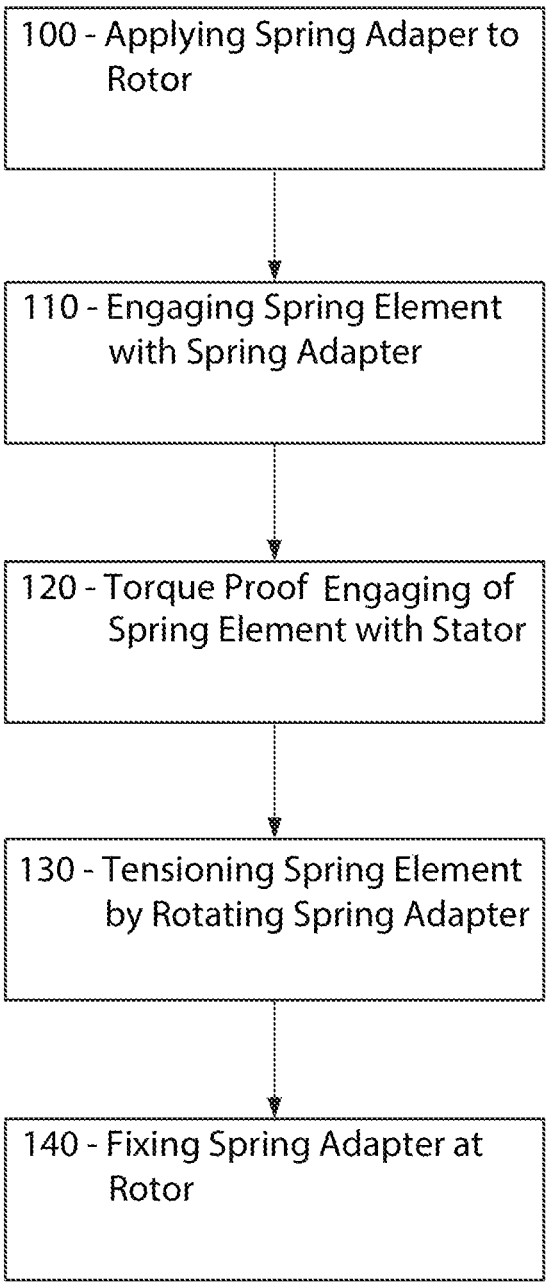
FIG. 7 illustrates a flow diagram for a method according to the invention for mounting the cam phaser according to the invention.

FIG. 7 illustrates a flow chart for a method for mounting a cam phaser 1 according to FIGS. 1-6. The method includes applying 100 the spring adapter 5 to the rotor 14, engaging 110 the spring element 15 in the spring adapter 5, torque proof engaging 120 of the spring element 15 with the stator 13, tensioning 130 of the spring element 15 by rotating the spring adapter 5 using an assembly tool and fixing 140 the spring adapter 15 at the rotor 14.

Another embodiment relates to a vane type cam phaser for an internal combustion engine, the vane type cam phaser comprising a stator, a rotor that is rotatable relative to the stator, wherein the rotor is configured to adjust a phase angle of a cam shaft, a spring element configured to generate a torque between the stator and the rotor, a spring adapter arranged between the spring element and the rotor, wherein the spring adapter is rotated during assembly to preload the spring element and fixated thereafter by a fixing device, wherein a rotation of the spring adapter is limited by a mechanical stop which defines an angular orientation for fixing the spring adapter.

For example the rotor or a component that is fixed at the rotor during rotation of the spring adapter includes a first contact surface. The spring adapter or a component that is fixed at the spring adapter during the rotation of the spring adapter includes a second contact surface.

According to another embodiment at least one additional component can be arranged as an intermediary element between the two contact surfaces when rotating the spring adapter so that the two contact surfaces do not have a direct contact. For example the intermediary element is an element of the assembly line. The intermediary element can also be an element of the preassembled fixing device.

According to an advantageous embodiment the rotor and the stator are positioned relative to each other before loading the spring element, the spring adapter is positioned axially and the spring element is positioned axially without preloading. The spring element is preloaded by rotating the spring adapter and the elements of the fixing device of the spring adapter are not yet assembled or preassembled when the spring adapter is rotated.

According to another embodiment the spring adapter is freely rotatable between the non-loaded position of the spring element and the loaded position of the spring element. The spring adapter or a component that is fixed at the spring adapter during rotation of the spring adapter for loading the spring element includes a drive contour for a tool. The rotation axis is formed by the contour of the drive of the prelaoding tool or an inner or outer contour of the spring adapter. For example the spring element is a torsion spring or a coil spring.

A fixed operating connection is provided between an end portion of the spring element and the rotor or a component that is fixed to the rotor and a second fixed operating connection is provided between the second end portion of the spring element and the stator or a component that is fixed at the stator. A locking disc that is connected to the stator torque proof is e.g. provided, wherein the spring element is interlocked in the locking disc.

Advantageously the fixing device of the spring adapter is configured with at least one fixing pin. The spring adapter and the rotor are respectively configured with at least one fixing opening, wherein the fixing opening is configured to receive the at least one fixing pin.

According to an advantageous embodiment the rotor has a sickle shaped contour which provides a movement path for at least one fixing pin when rotating the spring adapter during preloading of the spring element and which provides a stop for the fixing pin for a rotational positioning of the spring adapter relative to the rotor.

The rotor includes at least one recess wherein the spring adapter is interlock able in the recess.

A method for mounting the cam phaser includes the steps axial applying of the spring adapter to the rotor with the non-loaded spring element engaged in the spring adapter and the stator or a component fixed at the stator, preloading the spring element by rotating the spring adapter to a mechanical stop and subsequently axial fixing of the spring adapter at the rotor.

Advantageously at least one fixing opening in the spring adapter and at least one fixing opening in the rotor are aligned with each other during a rotation of the spring adapter. The axial fixing is performed e.g. by inserting a fixing pin into the fixing openings in the spring adapter and in the rotor.

According to an advantageous embodiment loading the spring element and fixing the spring adapter is performed through a mounting opening of the locking disc that is connected with the stator torque proof.

What is claimed is:

1. A vane type cam phaser for an internal combustion engine, the vane type cam phaser comprising:

a stator;

a rotor configured to rotate within the stator so as to adjust a phase angle of a camshaft;

a spring element configured to bias the rotor into a predetermined rotational position with respect to the stator;

a spring adapter arranged between the spring element and the rotor; and a locking disc fastened to the stator such that the spring element and the spring adapter are arranged between the locking disc and the rotor, wherein a first end of the spring element is engaged with the spring adapter and a second end of the spring element is engaged with the locking disc, wherein the spring element is in a free state when the locking disc is fastened to the stator, and wherein the spring element is tensioned by rotating the spring adapter relative to the rotor and fixing the spring adapter to the rotor at a predetermined fixing position.

2. The vane type cam phaser according to claim 1, wherein the spring element is a torsion spring.

3. The vane type cam phaser according to claim 1, further comprising:

a contact ring, wherein the second end of the spring element is engaged with the locking disc via the contact ring.

4. The vane type cam phaser according to claim 3, wherein the contact ring is made of steel.

5. The vane type cam phaser according to claim 1, wherein the spring adapter is rotated via a tool configured to engage an inner contour of the spring adapter.

6. The vane type cam phaser according to claim 1, wherein the spring adapter is fixed to the rotor via at least one fixing pin.

7. The vane type cam phaser according to claim 6, wherein the spring adapter includes at least one first fixing opening and the rotor includes at least one second fixing opening configured to receive the at least one fixing pin.

8. The vane type cam phaser according to claim 6, wherein the rotor includes a sickle shaped contour configured to receive the at least one fixing pin.

9. The vane type cam phaser according to claim 1, wherein the rotor includes at least one recess configured to receive the spring adapter.

10. A method for assembling a vane type cam phaser including a stator, a rotor, and a spring element configured to bias the rotor into a predetermined rotational position with respect to the stator, the method comprising:

inserting a spring adapter into the spring element;

applying the spring adapter to the rotor;

engaging a first end of the spring element the spring adapter;

engaging a second end of the spring element with a locking disc;

fastening the locking disc to the stator in a free state of the spring element;

tensioning the spring element by rotating the spring adapter with respect to the rotor; and fixing the spring adapter to the rotor at a predetermined fixing position.

11. A method according to claim 10, wherein the rotating of the spring adapter is supported in a sickle shaped contour of the rotor.

12. The method according to claim 3, wherein the fixing of the spring adapter includes aligning at least one first fixing opening of the spring adapter with least one second fixing opening of the rotor.

13. The method according to claim 12, wherein the fixing of the spring adapter further includes inserting a fixing pin into the at least one first fixing opening and the at least one second fixing opening.

14. The method according to claim 10, wherein the tensioning of the spring element and the fixing of the spring adapter is performed through a mounting opening of the locking disc.

* * * * *